US006141527A

United States Patent [19]

Fujiwara

[11] Patent Number: 6,141,527

[45] Date of Patent: Oct. 31, 2000

[54] IMAGE FORMING APPARATUS HAVING SEPARATING MEMBER WITH BIAS

[75] Inventor: Motohiro Fujiwara, Shizuoka-ken, Japan

[73] Assignee: Canon Kabushiki Kaisha, Tokyo, Japan

[21] Appl. No.: 09/354,573

[22] Filed: Jul. 16, 1999

[30] Foreign Application Priority Data

Jul. 21, 1998 [JP] Japan ..... 10-205298

[51] Int. Cl.[7] ..... G03G 15/14

[52] U.S. Cl. ..... 399/398

[58] Field of Search ..... 399/398, 399, 399/323, 315, 90, 48

[56] References Cited

U.S. PATENT DOCUMENTS

| | | | |
|---|---|---|---|
| 4,412,732 | 11/1983 | Ogata et al. | 399/66 |
| 4,579,441 | 4/1986 | Hart et al. | 399/315 |
| 5,557,389 | 9/1996 | Sato et al. | 399/315 |
| 5,621,513 | 4/1997 | Pitts et al. | 399/398 |
| 5,943,530 | 8/1999 | Ozasa | 399/129 |

FOREIGN PATENT DOCUMENTS

| | | |
|---|---|---|
| 1-217382 | 8/1989 | Japan . |
| 2-096787 | 4/1990 | Japan . |

*Primary Examiner*—Robert Beatty
*Attorney, Agent, or Firm*—Fitzpatrick, Cella, Harper & Scinto

[57] ABSTRACT

An image forming apparatus includes an image bearing member for bearing electrostatic images. A developing device develops the electrostatic images on the image bearing member with toner. A transferring device transfers the toner image on the image bearing member to a transfer material. A separating member abutting against the image bearing member separates the transfer material from the image bearing member. A voltage application device applies a voltage to the separating member so as to have a potential between an imaging portion and a nonimaging portion of the image bearing member at an abutting position of the separating member.

6 Claims, 8 Drawing Sheets

IMAGE FORMING APPARATUS HAVING SEPARATING MEMBER WITH BIAS

BACKGROUND OF THE INVENTION

1. Field of the Invention

The present invention relates to an image forming apparatus, such as a copying machine, a printer, that uses the electrophotographic method or the electrostatic recording method.

2. Related Background Art

In accordance with the electrophotographic method, the latent images on the photosensitive body are developed with the toner, and then, transferred to a transfer sheet.

For an image forming apparatus of transfer type of the kind, it is practiced to arrange the separation claws to be abutted against the image bearing member in order to reliably separate a transfer material from the image bearing member.

As a result, after the transfer, the residual toner is allowed to adhere to the separation claws which are in contact with the image bearing member.

The adhering toner is gradually aggregated, thus creating a phenomenon that the toner thus aggregated falls off on the transfer material as solid particles in some cases.

This phenomenon may take place more often when using one component magnetic toner which has a higher cohering tendency.

SUMMARY OF THE INVENTION

It is an object of the invention to provide an image forming apparatus which does not allow toner to fall off from the separation member.

It is another object of the invention to provide an image forming apparatus which does not allow toner to adhere to the separation member.

Other objectives of the present invention will be apparent from the following description.

DETAILED DESCRIPTION OF THE PREFERRED EMBODIMENTS

Figure 1:
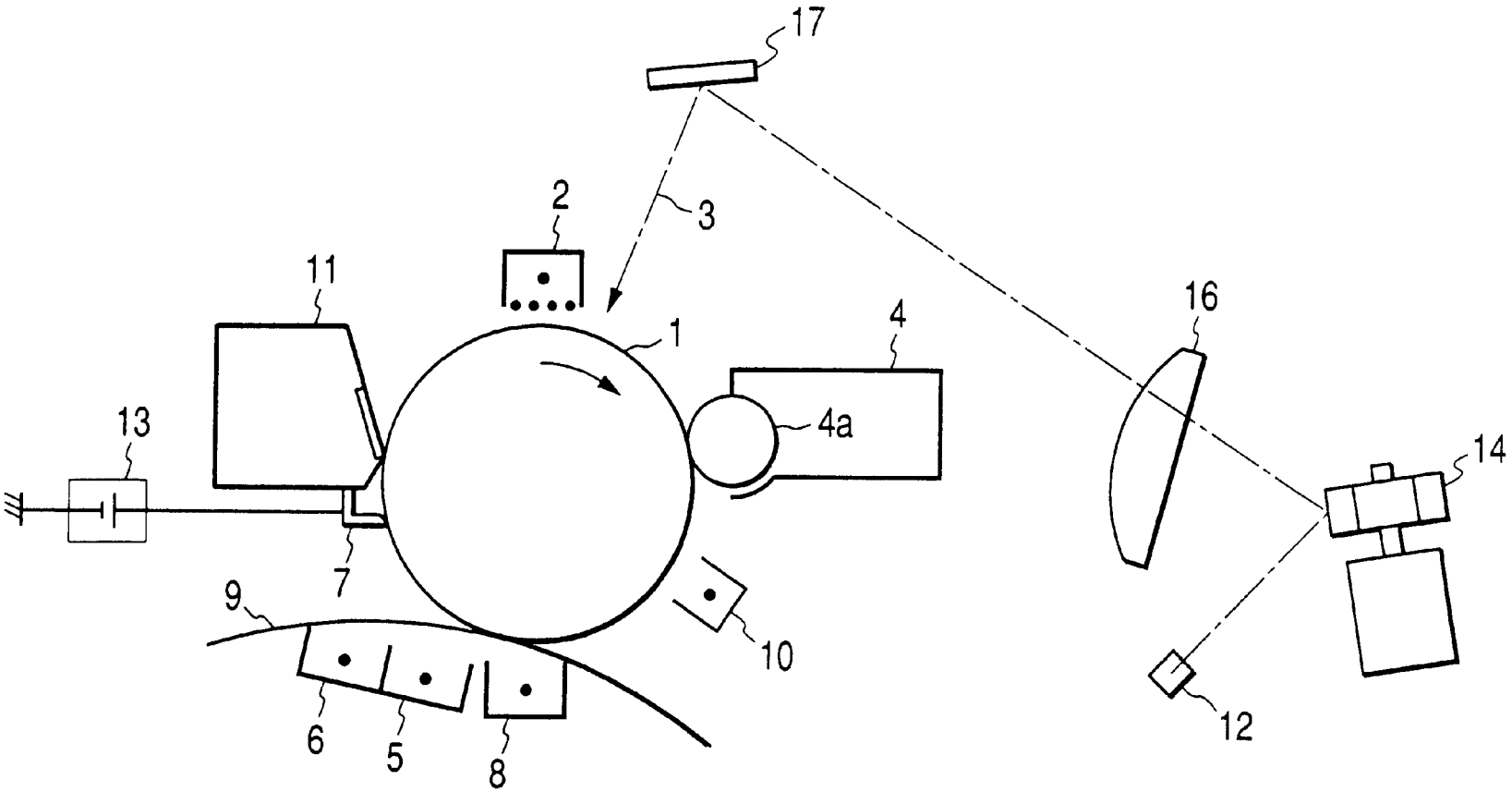
FIG. 1 is a view which schematically shows an image forming apparatus in accordance with a first embodiment of the present invention.

We will explain the embodiments of the present invention with reference to the accompanying drawings. FIG. 1 is a view which schematically shows the structure of an image forming apparatus in accordance with the present embodiment. In FIG. 1, a reference numeral 1 designates an image bearing member which is formed by an amorphous silicon photosensitive body or the like, for example, that bears electrostatic latent images; 2, a primary charger that charges the surface of the image bearing member 1 uniformly; 3, the laser beam that irradiates the image bearing member 1 to form electrostatic latent images on the image bearing member 1; and 4, the developing device that develops the latent images by applying voltage across the development sleeve 4*a* and the image bearing member 1 for the formation of the toner images on the image bearing member 1.

The pretransfer charger 10 uniformalizes the charged amount of the toner images formed on the image bearing member 1, the transfer charger 8 transfers the toner images formed on the image bearing member 1 to a transfer material 9, the first separation charger 5 and second separation charger 6 separate the transfer material 9 from the image bearing member 1 and the separation claws 7 separate the transfer material 9 which cannot be separated by the first separation charger 5 and the second separation charger 6.

The separation claw voltage application device 13 applies voltage to the separation claws 7, the cleaning device 11 removes the residual toner adhering to the image bearing member 1, the semiconductor laser 12 irradiates the laser beam 3 which is modulated in accordance with image signals, the laser beam 3 is arranged to raster scan the image bearing member 1 through a focusing lens 16 after reflection by means of a rotary polygon mirror 14 and the reference numeral 17 designates a reflection mirror.

Now, the description will be made of a part of the functions of the image forming apparatus described above.

Figure 2A:
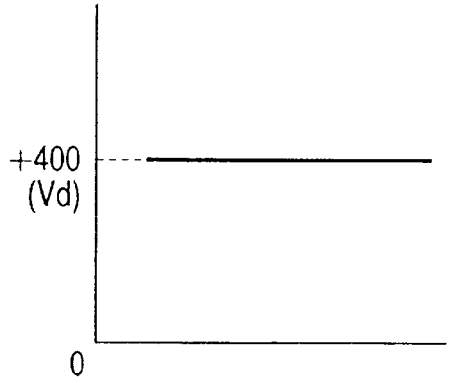
FIGS. 2A, 2B, 2C, 2D and 2E are views which schematically illustrate the potential of the surface of the image bearing member and the transfer material in accordance with the first embodiment of the present invention.
Figure 2B:
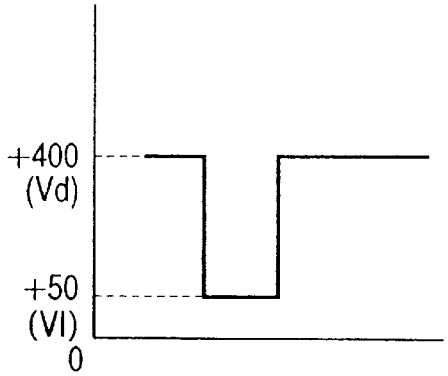
Figure 2C:
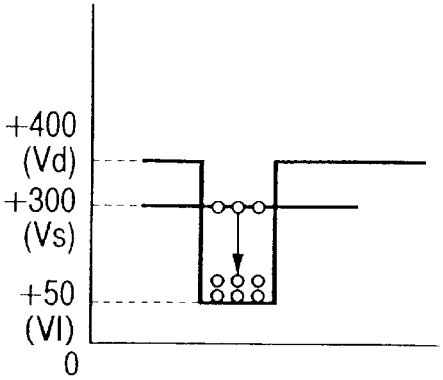

As shown in FIG. 2A, the image bearing member 1 is uniformly charged to +400V (Vd) by use of the primary charger 2. Then, as shown in FIG. 2B, the latent images are formed at +50V (Vl) by the irradiation of the laser beam 3. Here, the reference mark Vd designates the potential charged by use of the primary charger 2, and the reference mark Vl designates the potential attenuated by the irradiation of the laser beams 3. Then, as shown in FIG. 2C, the toner images are formed with the adhesion of toner to the Vl portion when the electrostatic latent images are inversely developed with the toner which is positively charged by the application of the positive DC voltage Vs to the development sleeve 4*a*.

In this respect, it is ideal if all the toner is positively charged. In practice, however, there exists the inverted toner which is negatively charged. The toner negatively charged adheres to the potential portion at +400V.

Figure 2D:
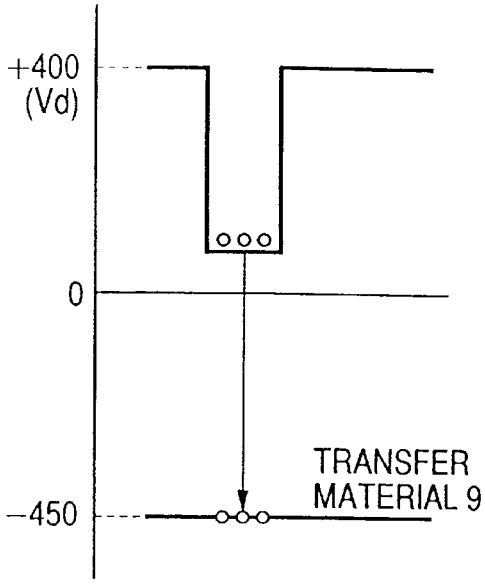

After that, the charged amount of toner is made substantially uniform by use of the pretransfer charger 10. Then, by use of the transfer charger 8, a negative potential is given to the reverse side of the transfer material 9, and as shown in FIG. 2D, the potential of the reverse side of the transfer material becomes −450V, hence transferring the toner images to the transfer material 9.

Figure 2E:
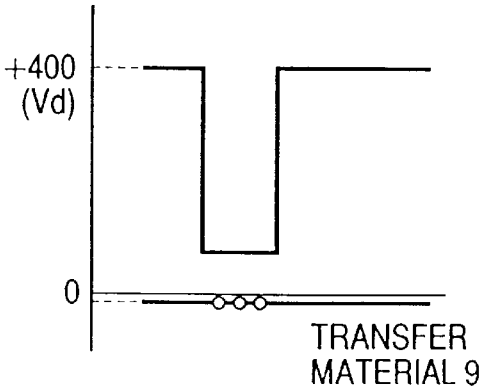

Thus, by use of the separation chargers 5 and 6, the unwanted negative potential given to the reverse side of the transfer material 9 is removed to make the potential of the transfer material almost 0 volt as shown in FIG. 2E. The adsorption between the transfer material 9 and the image bearing member 1 becomes weaker to enable the transfer material 9 to be separated from the image bearing member 1 in good condition to obtain the desired images on the transfer material 9.

The functions described above are simplified for illustration, and all the potential is indicated in terms of the one at the development position. In practice, however, the potential becomes smaller as the time elapses due to the dark decay, that is, the potential becomes smaller as it is farther on the downstream side along the rotational direction of the image bearing member 1.

Figure 3:
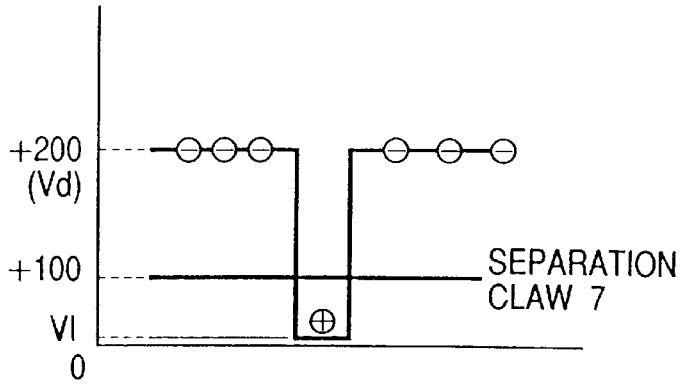
FIG. 3 is a view which schematically shows the potential of the surface of the image bearing member and the separation claws at the position of the separation claws in accordance with the first embodiment of the present invention.
Figure 4A:
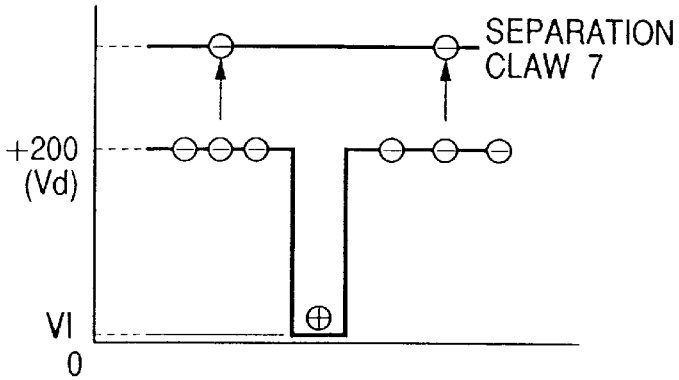
FIGS. 4A and 4B are views which schematically illustrate the potential of the surface of the image bearing member and the separation claws at the position of the separation claws when the potential of the separation claws of the first embodiment of the present invention is different from that of the present invention.
Figure 4B:
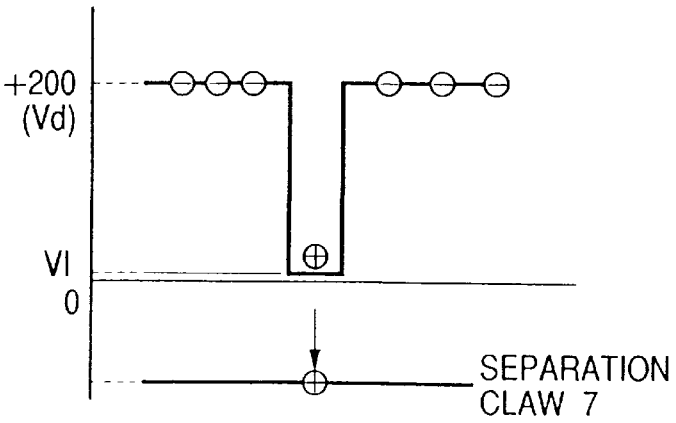

In this respect, FIG. 3 and FIGS. 4A and 4B illustrate the potential of the image bearing member 1 at the position of the separation claws 7. There is transfer residual toner present on the image bearing member 1 at the position of the separation claws 7. Such residual toner is also shown together with the charging polarity in FIG. 3 and FIGS. 4A and 4B.

Since the transfer residual toner is mostly the toner that has not been transferred, most of the toner is negatively charged one adhering to the Vd. Also, in FIG. 3, and FIGS. 4A and 4B, the potential of the separation claws 7 is shown.

In FIG. 3, the separation claws 7 are charged at +100V by use of the separation claw voltage application device 13. This voltage application is needed to give potential to the separation claws 7 intermediate the Vd and Vl at the position of the separation claws 7. In this manner, the transfer residual toner is not caused to adhere to the separation claws 7 irrespective of the charging polarity of the transfer residual toner. As a result, no toner adheres to the separation claws 7. No cohered toner falls off, either.

As shown in FIG. 4A, however, if the potential of the separation claws 7 is higher than the Vd or as shown in FIG. 4B, if it is smaller than the Vl, the transfer residual toner is allowed to adhere to the separation claws 7 after all. As a result, the toner cohering is generated, which falls off when it adheres to the separation claws in a certain amount.

Here, the structure of the separation claws 7 will be described in accordance with the present embodiment.

Figure 5:
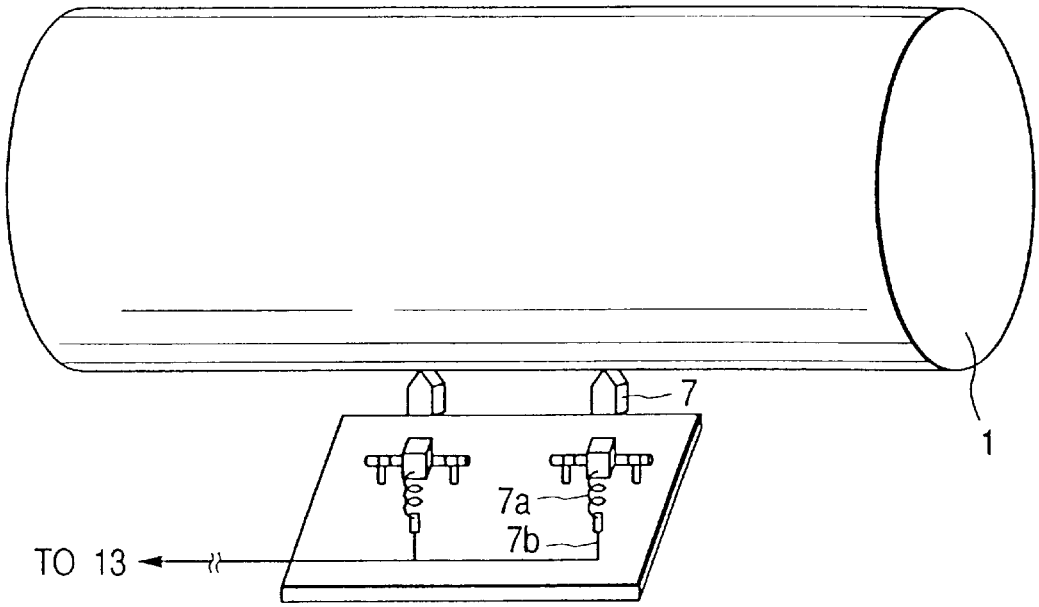
FIG. 5 is a view which schematically shows the vicinity of the separation claws in accordance with the first embodiment of the present invention.

FIG. 5 is a schematic view which shows the vicinity of the separation claws 7. The separation claws 7 are in contact with the image bearing member 1 under an appropriate pressure. With each of the separation claws 7, a separation claw pressure spring 7*a* is connected to exert this appropriate pressure. Each of the separation claw pressure springs is formed by SUS, and is made conductive.

Also, with each of the separation claw pressure springs 7*a*, the separation claw voltage application device 13 (not shown) is connected through the lead line 7*b*, respectively.

For the present embodiment, the separation claws 7 are formed by polyamide. However, it is not necessarily limited to this material. For example, polyetherimide or the like may be used if such material is not easily broken but does not cause any damage to the image bearing member 1 even when it may collide with a transfer material.

Also, the separation claws 7 are carbon coated in order to secure conductivity on the surface of the separation claws 7. Any other coating may be possible if only the material is conductive or conductive material may be used for the separation claws 7 themselves. In either case, it should be good enough if only a certain conductivity is secured on the surface of the separation claws 7.

In this respect, the surface resistance of the separation claws 7 is 20 kΩ for the present embodiment.

With the structure arranged as described above, it becomes possible to obtain the potential of the surface of the separation claws 7 as desired. As a result, there is no toner adhesion to the separation claws 7. There is no fall off of the cohered toner, either, hence making it possible to obtain images in good condition without staining the images on the transfer material 9.

(Second Embodiment)

The present embodiment is the example in which the present invention is applied to the regular development system where the development is made using the potential of an electrostatic image and the toner having the inverted polarity.

Now, the functions of the image forming apparatus will be described in accordance with the present embodiment.

Figure 6A:
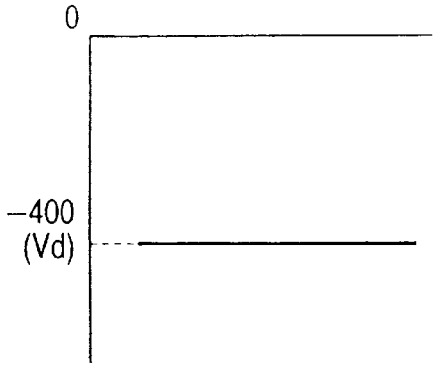
FIGS. 6A, 6B, 6C, 6D and 6E are views which schematically illustrate the potential of the surface of the image bearing member and a transfer material in accordance with a second embodiment of the present invention.
Figure 6B:
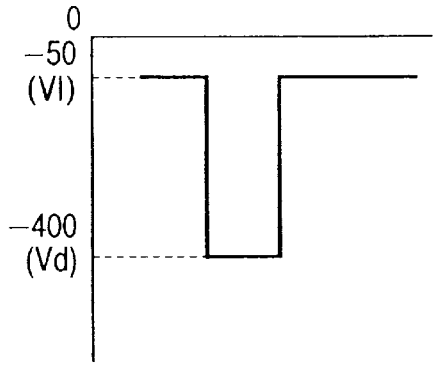
Figure 6C:
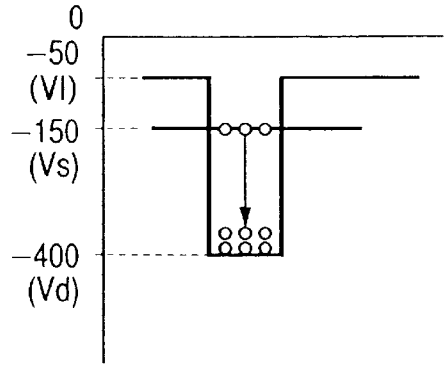
Figure 6D:
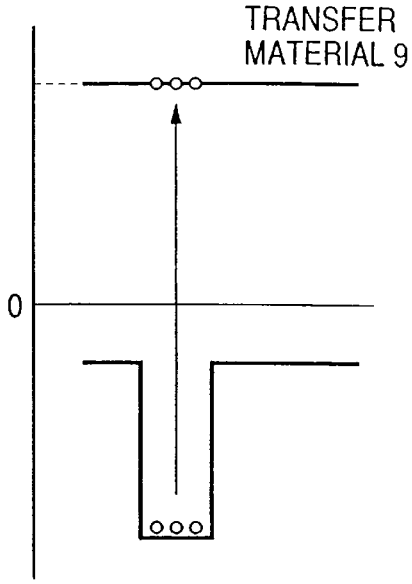
Figure 6E:
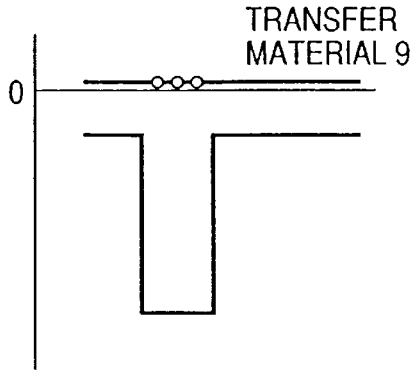

As shown in FIG. 6A, the image bearing member 1 is charged by the primary charger 2 at −400V (Vd) uniformly, and as shown in FIG. 6B, the electrostatic image is formed by the irradiation of the laser beam 3 at −50V (Vl). Then, the DC voltage Vs is applied to the development sleeve 4a for the regular development of the electrostatic image by use of the positively charged toner. Then, as shown in FIG. 6C, the toner image is formed.

In this respect, it is ideal if all the toner is positively charged. In practice, however, there exists toner which is negatively charged.

Then, the charged amount of toner is made substantially uniform by use of the pre-transfer charger 10. After that, by use of the transfer charger 8, a positive potential is given to the reverse side of the transfer material 9. The toner image is transferred to the transfer material 9.

Then, by use of the separation chargers 5 and 6, the unwanted positive potential given to the reverse side of the transfer material 9 is removed to make the adsorption weaker between the transfer material 9 and the image bearing member, hence separating the transfer material 9 from the image bearing member 1 in good condition to obtain the desired images on the transfer material 9.

Figure 7:
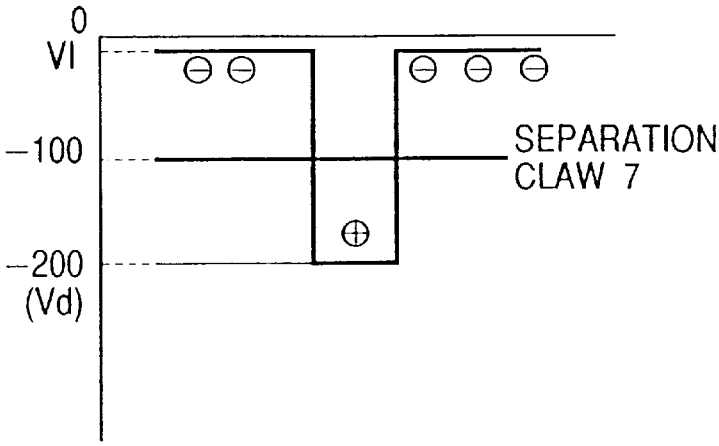
FIG. 7 is a view which schematically shows the potential of the surface of the image bearing member and the separation claws at the position of the separation claws in accordance with the second embodiment of the present invention.

The functions described above are simplified for illustration as in the case of the first embodiment, and all the potential is indicated in terms of the one at the development position. Here, FIG. 7 shows the potential of the image bearing member 1 at the position of the separation claws 7. FIG. 7 shows the transfer residual toner and the charging polarity, as well as the potential of the separation claws 7 as in FIG. 3.

Now that the transfer residual toner is mostly the toner that has not been transferred, most of the toner is negatively charged one adhering to a portion having a voltage Vl unlike the first embodiment.

The separation claws 7 are charged at −100V by use of the separation claw voltage application device 13 so as to give potential to the separation claws 7 intermediate the Vd and Vl at the position of the separation claws 7.

In this manner, as in the first embodiment, the transfer residual toner is not caused to adhere to the separation claws 7 irrespective of the charging polarity of the transfer residual toner. As a result, no toner adheres to the separation claws 7. No cohered toner falls off, either.

Also, the same effect is obtained for the regular development system, hence making it possible to obtain images in good condition without generating any cohered toner fall off.

(Third Embodiment)

The present embodiment is the example in which the voltage applied to the separation claws 7 is changed when the Vd or the Vl changes.

The Vd or the Vl may change in some cases depending on the environmental conditions, the transfer materials 9, the kinds of image, the modes, or the like. In such a case, the voltage applied to the separation claws 7 should be changed. In accordance with the present embodiment, such change of voltages takes place when the user switches the mode to the toner consumption saving mode.

Figure 8:
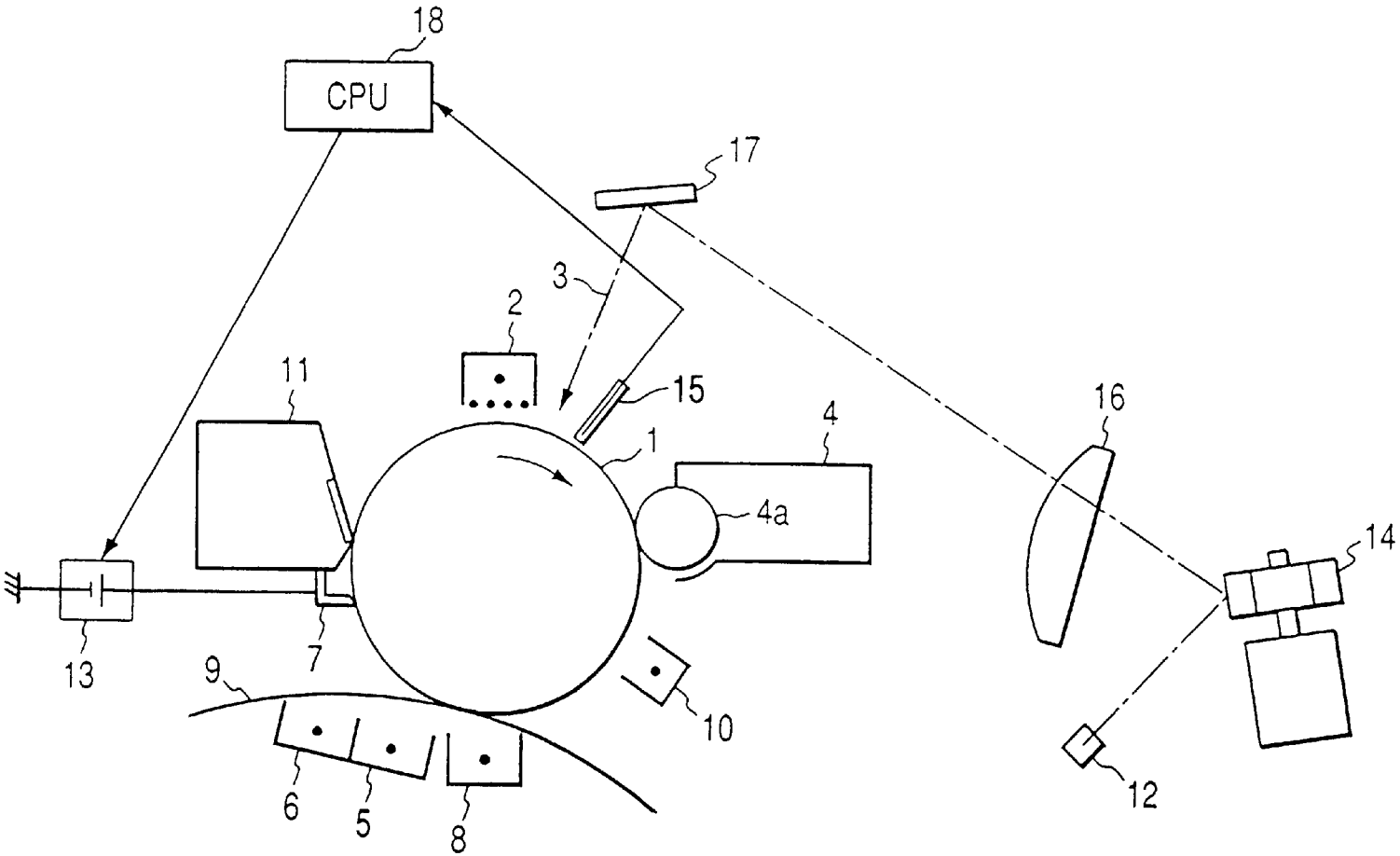
FIG. 8 is a view which schematically shows the image forming apparatus in accordance with a third embodiment of the present invention.
Figure 9A:
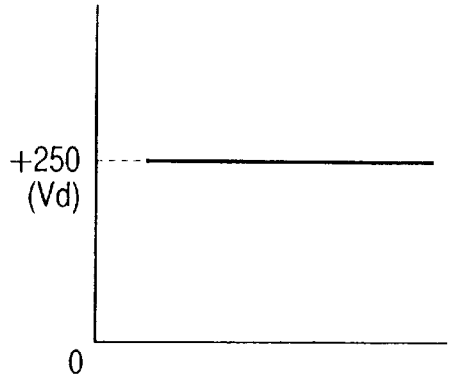
FIGS. 9A, 9B, 9C, 9D and 9E are views which schematically illustrate the potential of the surface of the image bearing member and a transfer material in accordance with a third embodiment of the present invention.
Figure 9B:
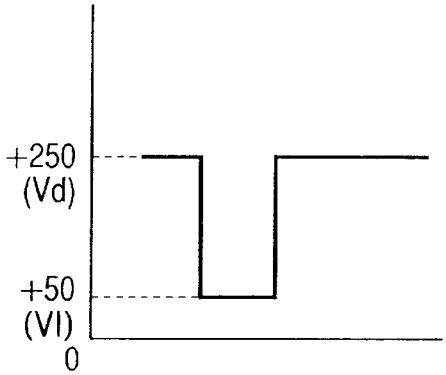
Figure 9C:
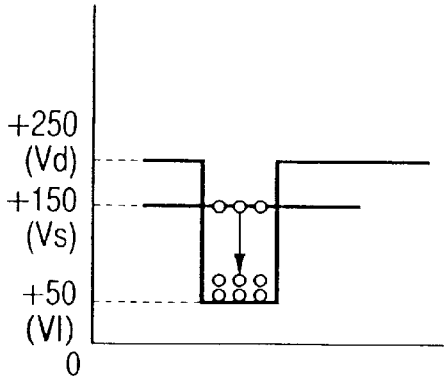
Figure 9D:
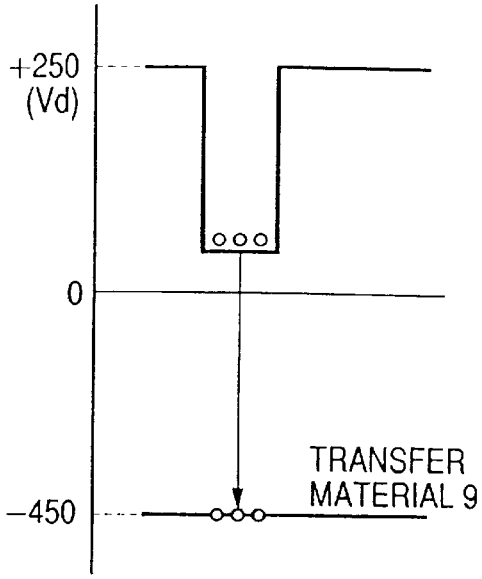
Figure 9E:
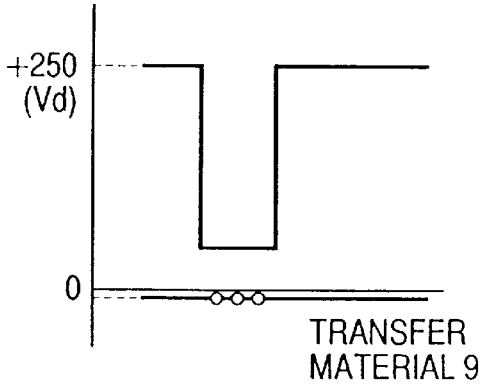

FIG. 8 is a view which schematically shows the image forming apparatus in accordance with the present embodiment.

In FIG. 8, there are represented an electrometer 15 to measure the Vd or Vl, and also, a CPU 18 to obtain the Vd and Vl at the position of the separation claws 7 from the detected result of the electrometer 15 so as to determine the optimum voltage to be applied to the separation claws 7. These additional provisions are the aspect which differs from the representation of FIG. 1.

Now, in conjunction with FIGS. 9A to 9E, the description will be made of the functions of the present embodiment. In this respect, the functions are almost the same as those of the first embodiment. The detailed description thereof will be omitted.

What differs from the first embodiment shown in FIGS. 2A to 2E is that the Vd is 250V, and the voltage Vs, which is applied to the development sleeve 4*a* accordingly, is 150V so as to save the toner consumption.

The measurement of the Vd and Vl may be made at all times during the formation of images or only a part thereof. However, it may be possible to measure only when the Vd and Vl are changed, and use the fixed value based on the result of such measurement thereafter. The measurement of the Vd and Vl at the time of its changes can be made immediately after such changes or immediately before the formation of images after the changes or there is no problem even at the time of image formation.

In accordance with the present embodiment, the Vd and the Vl are made available for measurement immediately before the formation of the images immediately after the modes are switched over. The result of the measurement at that time is: the Vd is equal to 265V, and the Vl is equal to 55V.

In order to determine the voltage that should be applied to the separation claws 7, there is a need for obtaining the potential at the position of the separation claws 7 bases upon the measurement result of the Vd and Vl with the dark decay of the image bearing member 1 which should be taken into consideration at that time. However, since the amount of the dark decay has its proper value per image bearing member 1, it is desirable to arrange two or more electrometers 15 to measure the amount of darkdecay which is characteristic of an image bearing member 1 immediately before the image forming apparatus is delivered.

Further, it is desirable to provide the electrometer 15 for another location to measure the amount of the darkdecay at all times, but this additional arrangement may lead to an significant cost increase. As an easy method, therefore, it may be possible to establish a specific value for the amount of dark decay of an image bearing member 1, which is not regarded as largely dependent on the variation of the image bearing members 1.

Figure 10:
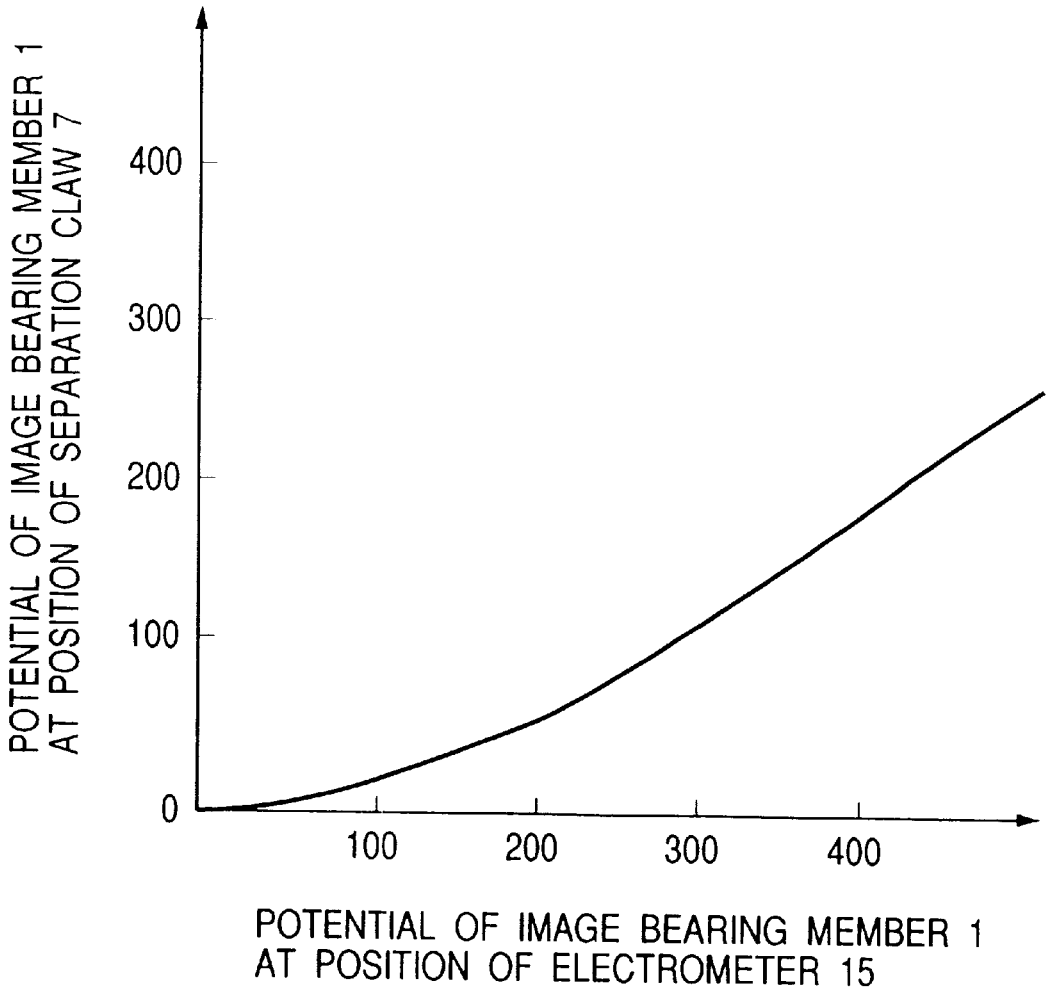
FIG. 10 is a graph which shows the amount of the dark decay of the image bearing member when it moves from the position of the electrometer to the position of the separation claws in accordance with the third embodiment of the present invention.

For the present embodiment, a certain mean value is adopted on the assumption that the system is not easily dependent on the variation of the image bearing members 1. FIG. 10 is a darkdecay graph used for the present embodiment. In FIG. 10, the axis X indicates the potential of the image bearing member 1 at the position of the electrometer 15. The axis Y indicates the potential of the image bearing member 1 at the position of the separation claws 7.

This graph represents the mean value of the results of the measurements when images are formed by use of a plurality of image forming apparatus each with the provision of an electrometer at the position of the separation claws 7 besides the electrometer 15. In accordance with the present embodiment, the potential of the image bearing member 1 obtainable from this graph at the position of the separation claws is 95V at the Vd, and 5V at the Vl. Therefore, a voltage of 50V is applied to the separation claws 7. As a result, no toner adheres to the separation claws 7, and no aggregated toner falls off, either, even when the Vd or the Vl is changed depending on the environmental conditions, the transfer materials 9, the kinds of image, the modes, or the like, hence making it possible to obtain images in good condition without staining them on the transfer material 9.

For the present embodiment, there is no problem even if there is no electrometer arranged in order to lower the costs. In such a case, the arrangement may be made so that the potential of image bearing member 1 at the position of the separation claws 7 is obtained from the electric current running on the primary charger 2 or the laser beam 3.

Although the present invention has been described with reference to these specific embodiments, it is not meant to be construed in a limiting sense. Various modifications of the disclosed embodiments, as well as other embodiments of the invention, will become apparent with reference to the description of the invention. It is therefore contemplated that the appended claims will cover any modifications as fall within the true scope of the invention.

What is claimed is:

1. An image forming apparatus comprising:

an image bearing member for bearing an electrostatic image;

developing means for developing the electrostatic image on said image bearing member with a toner;

transferring means for transferring a toner image on said image bearing member to a transfer material;

a separating member abutting against said image bearing member for separating the transfer material from said image bearing member; and voltage applicating means for applying voltage to said separating member so as to have a potential between an imaging portion and a non-imaging portion of said image bearing member at an abutting position of said separating member.

2. An image forming apparatus according to claim 1, said developing means reversal developing the electrostatic images.

3. An image forming apparatus according to claim 1, wherein said separating member is provided in plural numbers, and said voltage applicating means applies the same voltage to said plurality of separating members.

4. An image forming apparatus according to claim 1, wherein said apparatus further comprises a spring for pressing said separating member to said image bearing member, and said voltage applicating means applies voltage to said separating member via said spring.

5. An image forming apparatus according to claim 1, wherein a surface of said separating member is provided with a conductive layer.

6. An image forming apparatus according to claim 1, wherein said apparatus further comprises a potential sensor for detecting a surface potential of said image bearing member, and voltage control means for controlling a voltage to be applied to said separating member by said voltage applicating means in accordance with an output of said potential sensor.

* * * * *

UNITED STATES PATENT AND TRADEMARK OFFICE

CERTIFICATE OF CORRECTION

PATENT NO. : 6,141,527
DATED : October 31, 2000
INVENTOR(S) : Motohiro Fujiwara

It is certified that error appears in the above-identified patent and that said Letters Patent is hereby corrected as shown below:

Column 2,
Line 36, "uniformalizes" should read -- makes uniform --;
Line 54, "the" (first occurrence) should read -- a --;
Line 60, "(VI)" should read -- (VI) --;
Line 63, "V1" should read -- VI --; and
Line 65, "V1" should read -- VI --.

Column 3,
Line 25, "the" (first occurrence) should be deleted; and
Line 38, "one" should be deleted.

Column 6,
Line 61, "said" should read -- wherein said --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*